United States Patent [19]

Jonca

[11] Patent Number: 4,485,735

[45] Date of Patent: Dec. 4, 1984

[54] AUTOMATIZED PRINTING MACHINE AND PRINTING UNIT FOR SUCH A MACHINE

[75] Inventor: Henri V. J. Jonca, Toulouse, France

[73] Assignee: Societa Nationale Industrielle et Aerospatiale, France

[21] Appl. No.: 477,629

[22] Filed: Mar. 22, 1983

[30] Foreign Application Priority Data

Mar. 25, 1982 [FR] France ..... 82 05103

[51] Int. Cl.[3] ..... B41J 1/22

[52] U.S. Cl. ..... 101/93.21; 101/93.18; 101/110

[58] Field of Search ..... 101/57, 59, 93.18, 93.21, 101/93.24, 110, 111, 91, 92

[56] References Cited

U.S. PATENT DOCUMENTS

| | | | |
|---|---|---|---|
| 3,294,211 | 12/1966 | Mason | 400/154.3 |
| 3,916,785 | 11/1975 | Burger et al. | 101/110 X |
| 3,931,614 | 1/1976 | Vasa et al. | 101/93.18 X |
| 3,998,312 | 12/1976 | Fujimi et al. | 101/110 X |
| 4,127,064 | 11/1974 | Pettis, Jr. | 101/93.18 |
| 4,258,624 | 3/1981 | Mitsui | 101/110 X |
| 4,357,115 | 11/1982 | Or | 101/93.18 X |
| 4,409,892 | 10/1983 | Holland-Letz | 101/93.24 X |

OTHER PUBLICATIONS

IBM Technical Disclosure Bulletin, "Electromechanical Display" by Mouchon, vol. 9, No. 4, 9-66, pp. 363-364.

*Primary Examiner*—William Pieprz
*Assistant Examiner*—John A. Weresh
*Attorney, Agent, or Firm*—Marshall, O'Toole, Gerstein, Murray & Bicknell

[57] ABSTRACT

This invention relates to a printing machine provided with a printing head comprising a plurality of coaxial rotating printing wheels, wherein the control wheel is fast in translation with a carriage mobile parallel to the axis of said printing wheels and bearing two stepper motors, of which the first allows said carriage to slide and the second drives said control wheel in rotation. The invention is particularly applicable to the printing of parts, cables, wires, etc. . . . when they are manufactured.

4 Claims, 5 Drawing Figures

AUTOMATIZED PRINTING MACHINE AND PRINTING UNIT FOR SUCH A MACHINE

The present invention relates to an automatized printing machine for printing an identification code on any support, particularly on mechanical parts or electric cables.

It is known that modern methods of management, manufacture, assembly, mounting, maintenance, etc . . . render it indispensable to identify manufactured parts or elements in order to differentiate them from one another. Such a marking operation, which tends to be generalized, forms an important work station, for example in aeronautics, where the electrical wiring systems often constitute important masses of small-diameter conductors.

To effect such an identification marking, numerous apparatus are known.

Firstly, manual machines incorporating discs exist. For example, U.S. Pat. No. 3,572,239 describes a printing machine provided with a printing head comprising a plurality of coaxial rotating discs, disposed side by side and provided with printing types, and a wheel for controlling said discs having its axis parallel to that of the discs and adapted on the one hand to move parallel to the axis of said discs to come into contact or into engagement with any one of said discs chosen from the others and, on the other hand, to rotate about its axis to drive said chosen disc in rotation and bring into printing position a desired type thereon. In this known machine, the movement of translation and the movement of rotation of the control wheel are controlled by means of manually actuated knobs, with the result that adjustment of all the discs and blockage thereof in the desired positions are long and tedious operations. This is all the more so as, in this type of machine, it is often necessary to move the printing head in order to have access to the mechanism for adjusting the discs, whenever it is desired to modify the printing code. These drawbacks are accompanied by a high risk of errors when the change in printing code becomes frequent, as it proves tiring for the operators' eyes. In addition, such a machine is not compatible with a computerized system, as is generally required by present-day manufacture, and this considerably penalizes production.

Printing machines are also known which allow automatized printing.

For example, U.S. Pat. No. 3,868,638 describes a machine, managed by a computer and comprising, on the one hand, a rotating printing drum bearing a plurality of characters arranged along the generatrices and the parallels of said drum and, on the other hand, a plurality of juxtaposed printing hammers defining a line of print. Such a machine presents the drawback of being mechanically complicated and heavy. Moreover, it requires the use of comparators to determine the characters to be printed.

Another known automatized printing machine enables the plurality of printing hammers of the machine of U.S. Pat. No. 3,868,638 to be eliminated by using a plurality of discs in place of the printing drum. However, this other known machine must also be equipped with position encoders or comparators, coupled with the computer. These comparators inform the automatic control device on the position occupied by the printing discs and act thereon by means of racks. The printing adjustment operation is divided into two phases:

the return to zero of the printer, obtained by raising the racks to their highest point;

the adjustment which is made whilst the racks are descending. To each printing disc there corresponds one of said racks controlled by a motor by means of a rod which communicates to all the racks a rising and descending movement. An encoder disposed on the spindle of the control rod indicates to the computer the position of the characters as the movement progresses. As soon as the position of a disc corresponds to the character desired therefor, the associated rack may be mechanically blocked in its descending stroke by a pawl moved by a solenoid. The discs are thus successively positioned to form the code to be marked.

These known automatized printing machines are thus heavy and voluminous. Their mechanics are complex and difficult to adjust. In addition, the delicate nature of their adjustment prevents them from being handled in space to use them in a configuration or a position other than that of the adjustment, which considerably limits use thereof.

It is an object of the present invention to provide an automatized printing machine which is mechanically much simplified, which may be used in any desired work position, for example in overhang at the end of a support arm, and controlled very simply, whilst having a very rapid, optimalized adjustment.

To this end, according to the invention, the printing machine provided with a printing head comprising a plurality of coaxial rotating printing wheels, disposed side by side and provided with printing characters, and a wheel for controlling said printing wheels having its axis parallel to that of said printing wheels and adapted, on the one hand, to move parallel to the axis of said printing wheels to come into contact or into engagement with any one of said printing wheels chosen from the others and, on the other hand, to rotate about its axis to be able to rotate said chosen printing wheel and bring into printing position a desired character thereon, is noteworthy in that said control wheel is fast in translation with a carriage mobile parallel to the axis of said printing wheels and bearing two stepper motors, of which the first allows said carriage to slide and the second drives said control wheel in rotation and in that a device for controlling said stepper motors is provided, comprising memory means storing for each printing wheel the number of steps of the second motor, measured with respect to an origin of rotation of the printing wheel, corresponding to the character of the printing wheel at the time in position of print, data display means indicating, for each printing wheel, the number of steps of the second motor, measured with respect to said origin, corresponding to a character of the printing wheel which it is now desired to bring into position of print, calculating means for making, for each printing wheel, the difference between the number of steps stored and the number of steps displayed, controlled supply means for the first motor to bring the control wheel successively opposite each printing wheel and controlled supply means for the second motor to rotate each printing wheel by a number of steps equal to the corresponding difference, when the drive wheel is located opposite this printing wheel.

It is thus seen that the mechanical part of the machine according to the invention is particularly simple, since it necessitates neither comparators nor position encoders. It may form a compact assembly in which the printing wheels and the carriage, provided with the two stepper motors and the control wheel, are mounted on a common chassis. In this mechanical assembly, the movement of slide of the carriage may be effected whatever the position of the chassis, with the result that said assembly may occupy any appropriate work position.

In an advantageous embodiment, said memory means, said data introduction or display means and said calculating means are grouped together in a computer, or form a peripheral unit of such a computer, whilst the controlled supply means for the two stepper motors are associated with an interface device and are mounted therewith, fast with said mechanical assembly, a link by cable, for example of the series transmission type, being provided between said computer and said interface device. In this way, the mechanical assembly and the interface device form a light, non-cumbersome printing unit which may be disposed in any desired and appropriate place in a complex manufacturing machine, since the series link enables said unit to be separated physically (but not electrically) from the computer. With respect to said computer, such a printing unit behaves like a simple peripheral unit (or terminal).

It will further be noted that, upon change of adjustment of the printing wheels, thanks to the structure provided by the invention, it is not necessary systematically to return the printing wheels to their origin, since the modification of adjustment takes place by difference. The change of printing code is therefore particularly rapid.

In order further to increase the rapidity of a change in code, it is furthermore provided, on the one hand, that said second motor is of the type adapted to rotate in both directions of rotation, and, on the other hand, that said calculating means are associated with means for comparing the difference in the numbers of steps delivered by said calculating means with the number of steps of motor corresponding to a rotation of 180° of the printing wheels, the result of said comparison being used to bring into printing position the character now desired by the rotation of smallest angular amplitude.

The controlled supply means of the stepper motors preferably form part of two asynchronous current loops, one of said loops concerning the operational modes of the machine and the other the control of the different actuators of said machine.

The invention will be more readily understood on reading the following description with reference to the accompanying drawings, in which.

In these Figures, identical references denote like elements.

Figure 1:
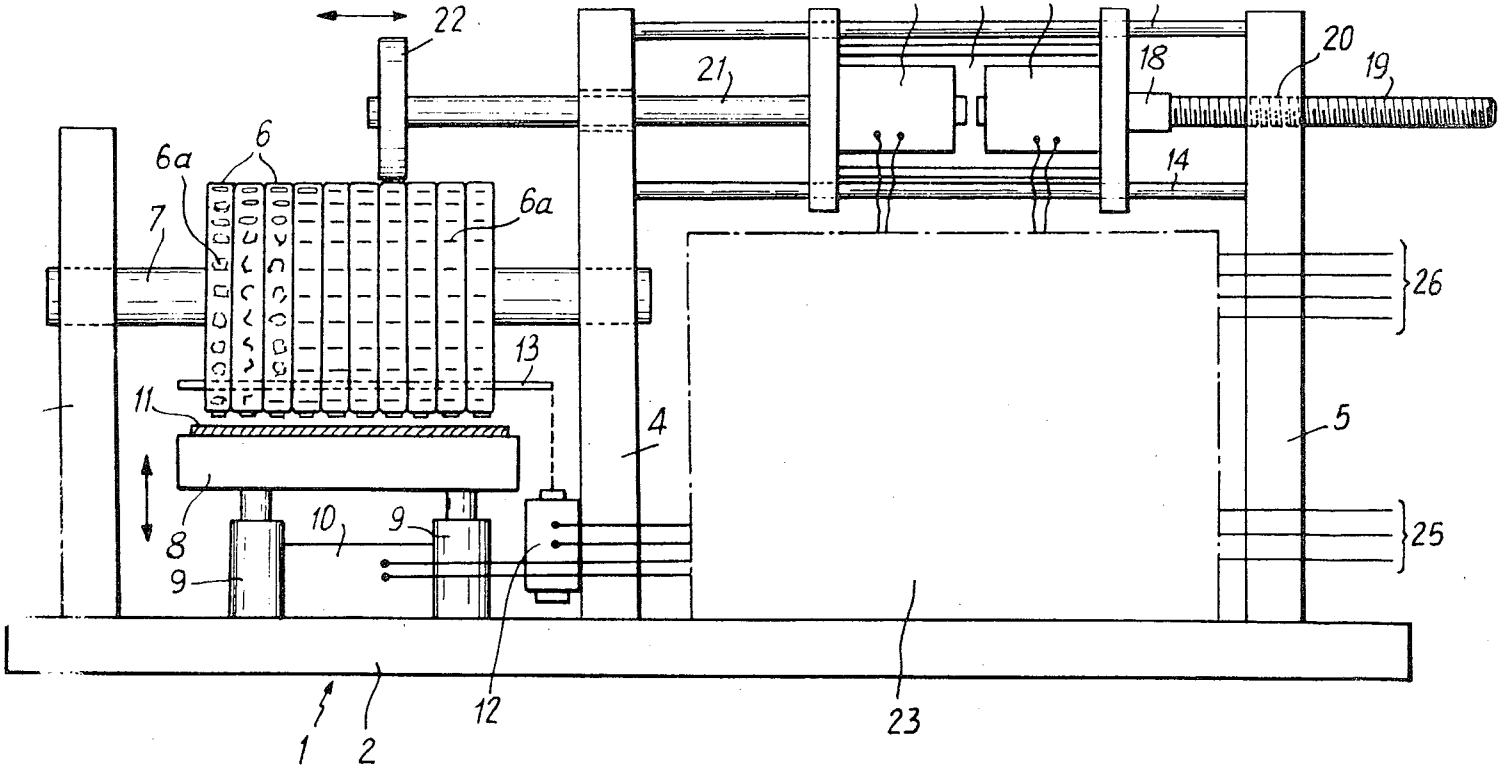
FIG. 1 shows the printing unit of the printing machine according to the invention.

Referring now to the drawings, the printing unit 1 of the printing machine according to the invention comprises a chassis composed of a base plate 2 on which are fixed three cheeks 3, 4 and 5, parallel to one another and at right angles to the base plate 2.

Between the cheeks 3 and 4 is mounted a plurality of printing wheels 6 provided on their periphery with characters 6a and adapted to rotate independently of one another about a common shaft 7, bearing at its ends on said cheeks 3 and 4. Opposite the printing wheels 6 there is provided a printing block 8 supported by jacks 9 which enable it to come into contact with said printing wheels and to move away therefrom. The jacks 9 are controlled by an electrovalve 10 and are supported by the base plate 2. On the block 8 rests a print support 11 which advances continuously. In FIG. 1, it has been assumed that the print support 11 is seen in transverse section and that it moves at right angles to the plane of the drawing. Of course, this print support 11, which is not necessarily a band but may be a cable, wire etc . . . , might equally well be in the plane of the Figure and advance over the printing block 8 from left to right or from right to left, possibly providing the appropriate passages in the cheeks 3, 4 and 5. A solenoid 12, fast with the chassis 2, 3, 4, 5 is adapted to actuate a locking bar 13, to immobilize the printing wheels 6 during the printing operations.

Between cheeks 4 and 5 are provided guide rails 14 on which a carriage 15 may slide in both directions. The rails 14 are parallel to each other and to the shaft 7 of the printing wheels 6. The carriage 15 bears two stepper motors 16 and 17 mounted in line, parallel to the rails 14 and to shaft 7. The shaft 18 of the motor 16 is extended by a threaded part 19 engaged in the corresponding thread of a threaded hole 20 in cheek 5, which thus forms nut. The shaft 21 of motor 17 passes freely through cheek 4 and is provided at its free end with a control wheel 22 which rotates therewith. The plane of the control wheel 22 is parallel to those of the printing wheels 6 and said control wheel 22 may be brought into contact with each of said printing wheels.

The electrovalve 10 for controlling the jacks 9, the solenoid 12 for controlling the locking bar 13 and the motors 16 and 17 are supplied by a device 23 which forms interface for a computer 24 (cf. also FIG. 2 in which the printing unit 1 is shown in the form of a box traversed by support 11) to which it is connected by a link 25. The device 23 may present other links 26 for the input and output of different information.

When it is desired to compose a marking code with the aid of the printing wheels 6, the computer 24 addresses the following orders to unit 1, via link 26:

deactivation (or activation) of the solenoid 12 by the device 23, so that the locking bar 13 releases the printing wheels 6 and that they can rotate;

activation of the stepper motor 16 by the device 23 so that it rotates its shaft 18 and in consequence of the threaded connection 19-20, the whole of the carriage 15 may slide along the rails 14, so that the control wheel 22 can be successively brought into contact with each of the printing wheels 6, for example starting with one of the end wheels. Activation of the stepper motor is discontinuous, intervening only upon passage of the control wheel 22 from one printing wheel 6 to the following, so that said control wheel 22 remains in contact with each of said printing wheels 6 for a sufficient period of stoppage to bring the desired character 6a of said wheel into print position, i.e. opposite the printing block 8;

activation of the stepper motor 17 by the device 23 during such periods of stoppage of the motor 16, so that, due to the connection (friction, engagement) between the control wheel 22 and the corresponding printing wheel 6, the desired type 6a is brought into print position;

activation (or deactivation) of the solenoid 12 by the device 23 in order, after adjustment of all the printing wheels 6, to lock them in position with a view to printing;

possibly, activation of the stepper motor 16 by the device 23 to return the carriage 15 to its initial position.

The marking code thus being composed and the print support 11 moving over the printing block 8, at every instant when it is desired to mark the support 11, it suffices to address an order to the device 23, either directly by links 26, or via the computer 24 and link 25, for said device 23 to actuate the jacks 9 through the electrovalve 10 so that the printing block 8 presses the support 11 against the characters 6a of the printing wheels 6 in print position.

For example, the computer 24 receives from a tacho generator 27 information on the speed of advance of the print support 11 and deduces therefrom electrovalve 10 control time intervals apt to obtain on the support 11 code markings distant by any desired length. It will further be noted that, between successive prints or markings on the print support 11, the printing unit 1 may possibly modify the printed code totally or partly.

Figure 3:
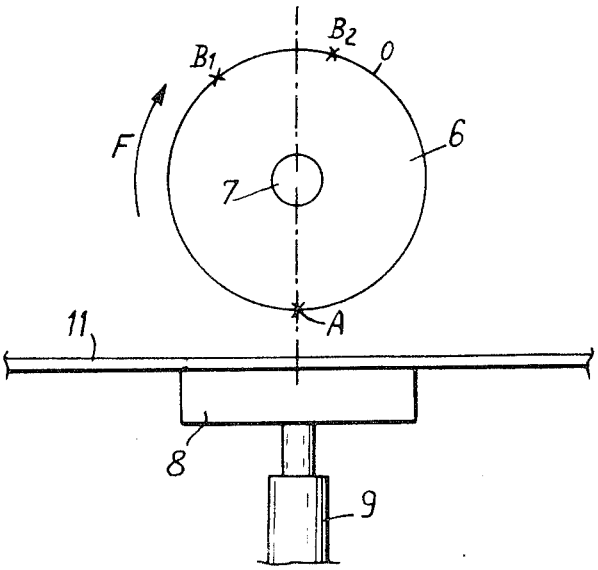
FIGS. 3 and 4 illustrate the process of adjustment of the printing wheels.
Figure 4:
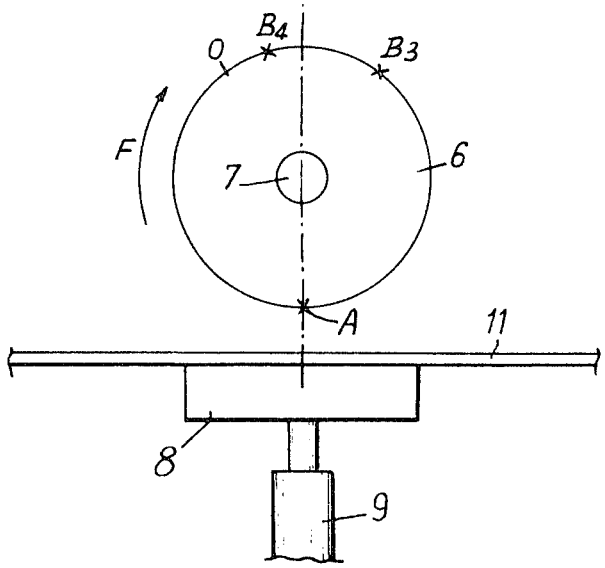

For the passage from one code to the other to be as short as possible, the computer 24 is preferably programmed so that the adjustment of each printing wheel 6 by the stepper motor 17 and the control wheel 22 is effected in the manner illustrated schematically in FIGS. 3 and 4. It is assumed that the characters 6a increase, from an origin O, in direction F of rotation in clockwise direction and that the number of steps on the motor 17 to rotate a printing wheel 6 by a half-revolution is equal to N. A represents the character 6a in print position which it is desired to change and B1, B2, B3 and B4 represent characters 6a which it is desired to bring into print position (i.e. in place of character A).

Figure 2:
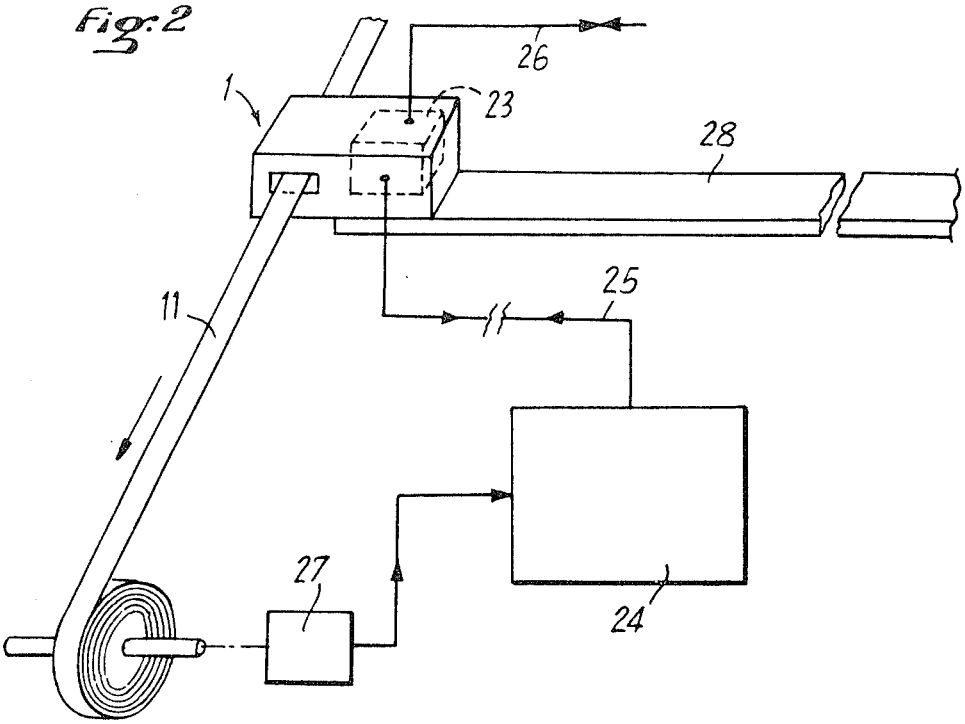
FIG. 2 is a schematic overall view of the printing machine according to the invention.

The process imposed by the computer 24 is as follows:

if the new character B1 to be brought into print position is greater than character A at the time in print position and if the difference C1=B1−A, which is positive, is less than or equal to N, the motor 17 is actuated in anti-clockwise direction (direction opposite F) by a number of steps corresponding to C1.

if the new character B2 to be brought into print position is greater than character A and if the positive difference C2=B2−A is greater than N, the motor 17 is actuated in clockwise direction (direction F) by a number of steps corresponding to 2N-C2;

if the new character B3 to be brought into print position is smaller than character A and if the difference D1=A−B3 is less than N, the motor 17 is actuated in clockwise direction (direction F) by a number of steps corresponding to D1;

if the new character B4 to be brought into print position is smaller than character A and if the difference D2=A−B4 is greater than N, the motor 17 is actuated in anti-clockwise direction (direction opposite F) by a number of steps corresponding to 2N-D2;

FIG. 2 shows the printing unit 1 borne at the end of an elongated support arm 28, which may be very long, the link 25 to the computer 24 also being of long length. Link 25 is preferably of the type with series transmission of logic levels 0 and 1, so that parallel-series and series-parallel transformation systems are provided in the device 23 and computer 24.

Figure 5:
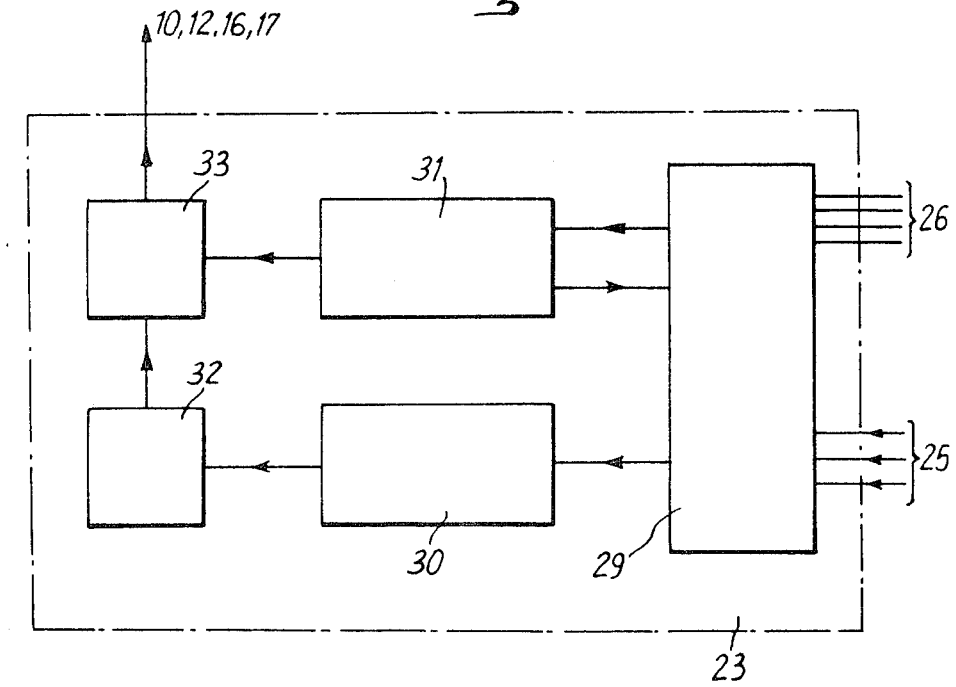
FIG. 5 shows the block diagram of the interface device.

As shown in FIG. 5, the device 23 comprises, in addition to an interface 29 proper comprising the corresponding parallel-series and series-parallel transformation devices, two asynchronous control current loops 30 and 31, each of series type, disposed in parallel on one another.

The loop 30, which corresponds to the operational modes of the whole printing machine, operates only in reception mode and is associated with a decoder 32 to decode the information received by links 26 to outside information generators and by link 25 to the computer 24. The functions of the loop 30 may be, inter alia, the validation of the parameters of the printing machine such as defect of support 11, end of cycle etc . . . , validation of the length of the support 11 to be printed, validation of the number of supports 11 to be printed, validation of the controls of motors 16 and 17, validation of the initialization and the displacements to right and left of the motors 16 and 17, validation of start-up and stoppage of the printing machine, etc . . . The loop 30 thus acts as monitoring device for the control device 23.

The loop 31 operates in transmission and reception mode and makes it possible to transmit to the computer 24 all the parameters concerning the printing machine, previously addressed by the loop 30 (generation of functions) or to receive from the computer 24 the different data necessary for operation of the printing machine (length and number of the or each support 11 to be printed, etc . . . ) and the control of the two stepper motors 16 and 17.

The information received by the loop 31 is switched, for example in device 33, by the functions generated by loop 30. They become, depending on their destination, a length of print support 11, a number of support 11, numbers of steps for the motors 16 and 17, signals for initialization of said motors, machine start-ups or stoppages, etc . . . . The information emitted by the loop 31 concerns for example the end of a print cycle, a defective support, etc . . . .

What is claimed is:

1. In a printing machine, a printing head comprising a plurality of parallel coaxial printing wheels rotatable about a first axis, each wheel being provided with printing characters, a carriage movable along a line parallel to said first axis, a first stepper motor and a second stepper motor carried by and movable with said carriage, actuation of said first motor causing said carriage to move along said line, a control wheel carried by and movable together with said carriage, said control wheel being driven by said second stepper motor for rotation about a second axis parallel to said first axis, said control wheel being adapted to engage directly any selected one of said printing wheels on actuation of said first motor and to bring a desired printing character on said selected wheel into printing position on actuation of said second motor;

said first and said second stepper motors being independently operable.

2. A printing machine in accordance with claim 1, further including a control device for controlling the operation of said stepper motors, said control device comprising:

memory means storing for each printing wheel the number of steps of said second motor, measured with respect to an origin, corresponding to the printing character of said wheel which is in printing position;

data display means displaying for each printing wheel the number of steps of said second printing motor, measured with respect to said origin, required to bring a desired printing character into printing position;

calculating means for calculating the numerical difference between the number of steps stored and the number of steps displayed for each of said wheels;

controlled actuating means for said first motor adapted to bring said control wheel successively into engagement with each printing wheel; and controlled actuating means for said second motor adapted to rotate each printing wheel during its engagement with said control wheel by the number of steps corresponding to said calculated difference.

3. A printing machine in accordance with claim 2, wherein said second motor is adapted to rotate in either direction and wherein said machine further includes:

comparison means for comparing said calculated numerical difference with the number of steps corresponding to 180° rotation of a printing wheel; and means for using the result of said comparison to rotate said second motor in the appropriate direction to bring a desired printing character into printing position through a rotation of the smallest angular amplitude.

4. A printing machine in accordance with claim 2, wherein said memory means, said data display means and said calculating means are incorporated in a computer; and said actuating means for said first and second stepper motors are incorporated in an interface device mounted on said machine;

said computer and said interface device being physically separated but electrically interconnected through a cable link.

* * * * *